United States Patent [19]

Totten, III

[11] Patent Number: 4,589,803

[45] Date of Patent: May 20, 1986

[54] METHOD AND APPARATUS FOR INSTALLING MINE ROOF SUPPORTS

[76] Inventor: Arthur B. Totten, III, 390 Darbys Run, Bay Village, Ohio 44140

[21] Appl. No.: 569,050

[22] Filed: Jan. 9, 1984

[51] Int. Cl.[4] ..... E21D 20/00; E21D 21/00

[52] U.S. Cl. ..... 405/259; 405/303; 299/11

[58] Field of Search ..... 405/258-261, 405/288, 303; 299/11; 173/38, 43; 411/15, 50, 361; 227/82, 85

[56] References Cited

U.S. PATENT DOCUMENTS

| | | | |
|---|---|---|---|
| 3,226,934 | 1/1966 | Emery . | |
| 3,842,610 | 10/1974 | Willis et al. | 405/259 |
| 3,913,338 | 10/1975 | Galis | 405/259 X |
| 4,079,592 | 3/1978 | Eakin | 405/260 |
| 4,085,492 | 4/1978 | Stange | 166/77 X |
| 4,095,431 | 6/1978 | Hannan | 405/259 |
| 4,289,427 | 9/1981 | Rolston | 405/258 X |
| 4,324,518 | 4/1982 | Dixon | 411/361 |
| 4,395,163 | 7/1983 | Perraud | 405/303 |
| 4,451,179 | 5/1984 | Bauer, Jr. | 405/260 |

OTHER PUBLICATIONS

Advertising brochure J. H. Fletcher & Co. entitled "Model DB-32 Low Profile, Angle Drilling Roof Bolter".

Advertising brochure J. H. Fletcher & Co. entitled "Model LTDO Low Profile, Single Head Roof Bolter".

Advertising brochure entitled "Single Boom Roof Drills" by FMC Corporation.

Article from "Coal Age" entitled Bureau Takes Lead in 1983 R&D, published in the issue dated Feb. 1983.

Undated Advertising brochure by Bendix entitled "Energy, Environment, & Technology Office"-Roof Bolt Inserter.

Advertising brochure entitled "General Purpose Straighteners" by Rockford Manufacturing Group, Roscoe, Ill. 61073.

*Primary Examiner*—Cornelius J. Husar
*Assistant Examiner*—Nancy J. Stodola
*Attorney, Agent, or Firm*—Yount & Tarolli

[57] ABSTRACT

An apparatus for use in installing mine roof supports includes a vehicle which carries a coil of rod material. The rod material is fed from the coil and straightened. The straightened rod material is inserted into a hole drilled in the roof of the mine. An anchor is set to hold the rod material in the hole. A mine roof support plate is pressed against the roof of the mine and a fastener is tightened against the mine roof support plate to hold it in place. The rod material is then cut to separate the length of rod in the hole from the coil.

7 Claims, 6 Drawing Figures

METHOD AND APPARATUS FOR INSTALLING MINE ROOF SUPPORTS

BACKGROUND OF THE INVENTION

The present invention relates to a new and improved method and apparatus for installing mine roof supports of the type which include a bolt which is mounted in a hole in the roof of the mine.

When a mine tunnel is cut into the earth, the material forming the roof of the mine is relatively weak and will tend to collapse unless it is supported. The roof of a mine has been supported by drilling holes in the roof of the mine and inserting bolts into the holes. The upper end of each bolt is anchored in a hole and the bolt is tightened against a mine roof support plate to compress material forming the mine roof.

When a mine roof is to be supported, a bolting machine has been used to drill holes in the roof of the mine. These holes may have a depth of eight feet or more. Once the holes have been drilled, a bolt must be placed in the hole. In a mine tunnel having a height of approximately three feet, it is necessary to bend an eight to ten foot long mine roof bolt two or three times as it is inserted into the hole. Due at least in part to the difficulty of placing mine roof bolts in the holes, there are, in favorable circumstances, two and perhaps three or four bolting machines for every mining machine.

SUMMARY OF THE PRESENT INVENTION

The present invention provides a new and improved method and apparatus for quickly installing mine roof supports. The apparatus includes a vehicle which carries a coil of rod material. After a hole has been drilled in the roof of the mine, preferably by a drill mounted on the vehicle, rod material is fed from the coil and straightened. The straightened rod material is inserted into the hole in the mine roof and anchored in place. A fastener is connected with the length of rod material in the hole to press a support plate upwardly against the roof of the mine. The rod material is cut to separate the length of rod material in the hole from the coil of material.

When a mechanical anchor is used with the rod material, the rod material is pulled downwardly with a relatively large force to firmly set the mechanical anchor in the hole in the mine roof. This relatively large downward force is then reduced and, while the reduced force is maintained on the rod material, a fastener is secured against the mine roof support plate to hold it in position. The downward force on the rod material is then released so that the rod material pulls the fastener firmly upwardly against the mine roof support plate. When a resin or grout type anchor is used, only the reduced or anchoring force is applied against the rod material.

Accordingly, it is an object of this invention to provide a new and improved method and apparatus for installing mine roof supports and wherein rod material is removed from a coil in a mine, straightened and inserted into a hole in the roof of the mine.

Another object of this invention is to provide a new and improved method and apparatus for installing mine roof support plates at a plurality of locations in a mine and wherein a coil of rod material is moved to each of the locations and rod material from the coil is inserted into holes in the mine roof.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

General Description

Figure 1:
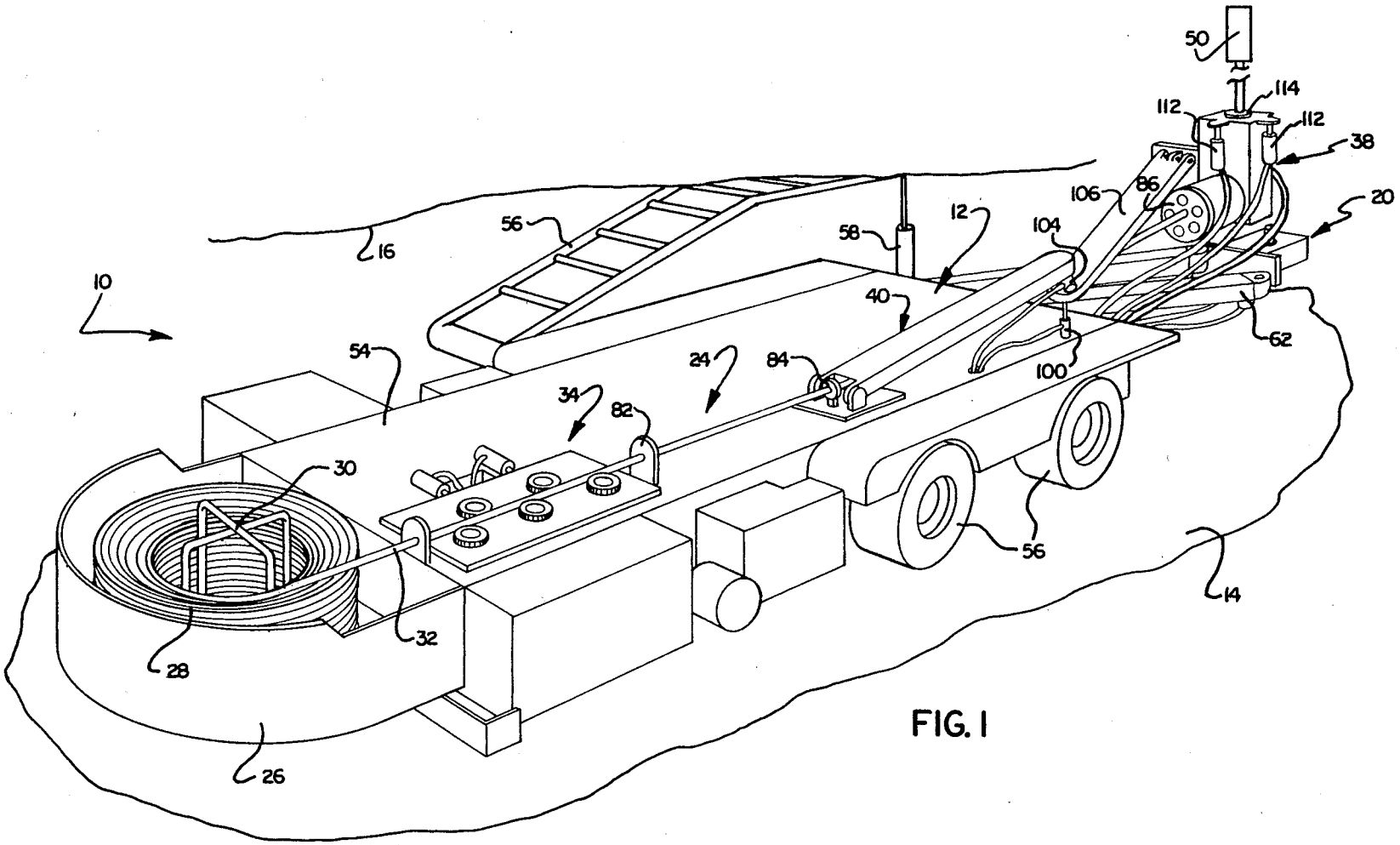
FIG. 1 is a simplified pictorial illustration of a machine constructed in accordance with the present invention to install mine roof supports.

A machine 10 for installing mine roof supports is illustrated in FIG. 1. The machine 10 includes a vehicle 12 which is movable along the floor 14 of a mine tunnel to locations where supports are to be installed in a roof 16 of the mine. The machine 10 includes a drill assembly 20 which is operable to drill holes in the roof of the mine. A mine roof bolt forming and installing apparatus 24 mounted on the vehicle 12 includes a carrier 26 in which a coil 28 of rod material is rotatably supported on a turntable 30.

Figure 2:
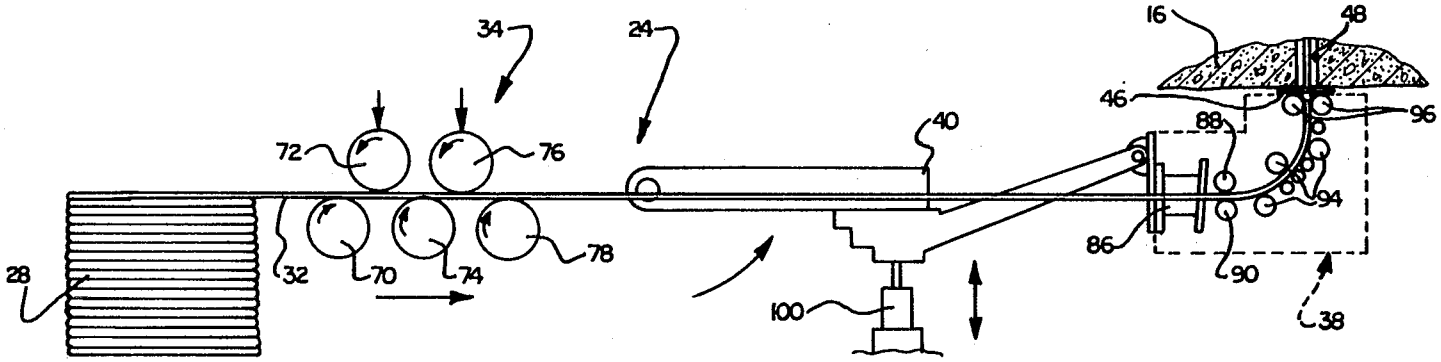
FIG. 2 is a schematic illustration depicting the manner in which rod material is removed from a coil, straightened and inserted into a hole in the roof of a mine during operation of the machine of FIG. 1.
Figure 5:
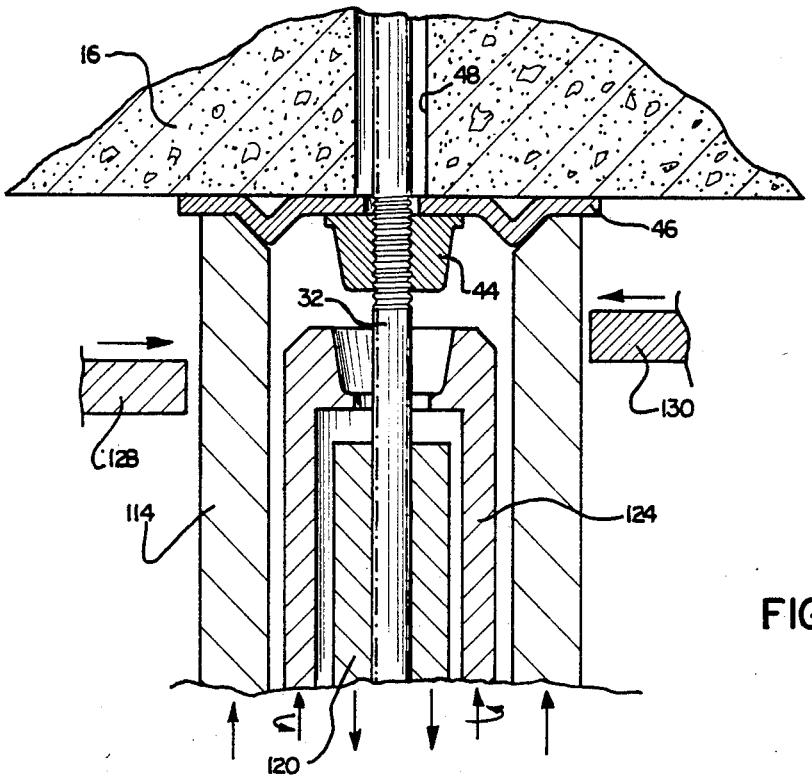
FIG. 5 is a fragmentary schematic sectional view illustrating the manner in which a mine roof support plate is pressed against the roof of a mine, a piece of rod material is gripped and pulled downwardly, and a fastener collar is swaged onto the rod material while it is loaded in tension, collar being shown swaged in place.

Rod material 32 is unwound from the coil 28 and straightened by a rod feeder and straightener assembly 34 (FIGS. 1 and 2). The feeder and straightener assembly 34 feeds a measured amount of straightened rod material 32 to an installation head 38 disposed on the outer end of a boom 40. The installation head 38 feeds the rod material 32 around a bend (FIG. 2) and upwardly through a fastener or collar 44 (FIG. 5) and a mine roof support plate 46 into a hole 48 in the roof 16 of the mine. The collar 44 initially has a central bore with a diameter which is larger than the outside diameter of the rod material 32 so that the rod material can be easily fed through the collar.

The mine roof support plate 46 may have any desired construction. However, it is preferred to use mine roof support plates similar to those shown in U.S. Pat. Nos. 4,037,418; 4,095,431 and 4,371,293.

After a desired length of rod material 32 has been fed upwardly into the hole 48 of the mine roof, an anchor 50 is set in the hole to secure the upper end of the rod material against downward movement. It is contemplated that either a resin/grout type anchor, such as disclosed in U.S. Pat. Nos. 3,877,235 and 4,132,080, or a mechanical anchor, similar to the one shown in U.S. Pat. No. 3,226,934, or a combination mechanical and resin/grout anchor, such as shown in U.S. Pat. Nos. 4,162,133 and 4,299,515, could be used. When a mechanical anchor is used, the anchor is advantageously of a construction such that a straight downward pulling action on the rod material 32 will pull an axially tapered wedge member downwardly and cam shell members radially outwardly into firm abutting engagement with the sides of the mine roof hole.

Once the anchor 50 has been set to hold the upper end of the rod material 32 in place in the hole 48, the collar 44 is deformed radially inwardly to securely grip the rod material 32 while the rod material is in tension. The rod material 32 is then cut to separate the length of rod in the hole in the mine roof from the coil 28. Once this has been done, the vehicle 12 is moved to another location in the mine where a roof support is to be installed.

Vehicle

The vehicle 12 is a commercially available mine roof drilling machine of the type which has been previously used to drill holes in the roof 16 of a mine. The vehicle 12 includes a low and generally rectangular base or frame 54 (FIG. 1) which is supported on four wheels 56. A canopy 58 is pivotally connected with the frame 54 and can be raised by operation of a hydraulic motor 58. A second hydraulic motor or stabilizing jack (not shown) is extendable downwardly against the floor 14 to hydraulically lock the vehicle 12 between the floor and roof 16. A boom 62 on which the drill assembly 20 is mounted is then raised by suitable hydraulic motors to drill a hole in the roof 16 of the mine in a known manner.

The vehicle 12 is a commercially available vehicle which is sold by FMC Corporation, Mining Equipment Division, Tenth & Belt Line, Fairmont, W.V. 26554. The specific vehicle 12 which has been schematically illustrated in FIG. 1 is sold by FMC as a Model 300 Single Boom Roof Drill. However, it is contemplated that the mine roof bolt forming and installing apparatus 24 could be used in association with many different types of vehicles. Thus, the mine roof bolt forming and installing apparatus 24 could be used with substantially different types of vehicles, such as a continuous mining machine which cuts material to form a mine tunnel.

Rod Feeding and Straightening

In accordance with a feature of the present invention, the mine roof bolts or support rods are formed in the mine from the coil 28 of rod material. The rod material 32 in the coil 28 could have any desired composition. However, it is believed that it may be preferred to use a 1018 steel. It is contemplated that the rod material will have a diameter of approximately $\frac{1}{2}$ to $\frac{3}{4}$ of an inch in the thread stress area.

A thread 66 is formed on the outside of the rod material 32. Although the thread could be of any desired form, the thread 66 may advantageously have an Acme type thread form with a rounded crest and root and approximately six turns to the inch. This is the same type of thread which has been referred to as a concrete "tie lag". The foregoing description of a specific thread form and pitch has been set forth herein merely for purposes of clarity of illustration rather than purposes of limitation of the invention.

The coil 28 of rod material is lowered into the mine and placed on the turntable 30 in the coil carrier 26. The turntable 30 supports the coil 28 for rotation about a vertical axis. Rod material 32 is pulled from the coil 28 by the rod feeder and straightener assembly 34.

Figure 3:
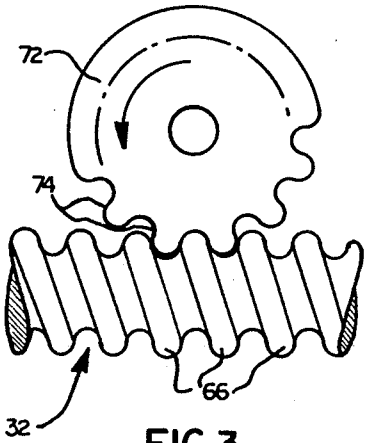
FIG. 3 is an enlarged schematic illustration depicting the manner in which a wheel in an apparatus for straightening and feeding the rod material engages the rod material.

The rod feeder and straightener assembly 34 has a plurality of identical driven wheels 70, 72, 74, 76 and 78 which are disposed in linear arrays on opposite sides of the rod material 32. The wheel 72 has a circular array of teeth 74 (see FIG. 3) which engage the thread on the rod material 32 to feed the rod material during counterclockwise rotation (as viewed in FIGS. 2 and 3) of the wheel 72. The wheel 76 (FIG. 2) also has teeth for engaging the thread form on the rod material 32 and is rotated in a counterclockwise direction.

The lower wheels 70, 74 and 78 are rotated in a clockwise direction (as viewed in FIG. 2) and have teeth which engage the thread on the rod 32. The rotation of the driven wheels 70–78 pulls the rod material from the coil 28 and feeds it toward the right (as viewed in FIG. 2). Since there is no slippage between the rod material 32 and the teeth of the wheels, a rotation counter connected with one of the wheels provides an accurate indication of the length of rod material which is fed from the coil 28.

The wheels 70–78 cooperate to straighten the rod material 32 as it is fed by the wheels. The manner in which the wheels 70–78 cooperate to straighten the rod material as it is fed and measured is well known and is the same as is found in single plane 5-roll straightener assemblies sold by Rockford Manufacturing Group of Roscoe, Ill. 61073. Of course, other known types of rod material straighteners could be used if desired.

The straightened rod material 32 leaves the rod feeder and straightener assembly 34 and moves through guides 82 and 84 (see FIG. 1) to the installation boom 40. The rod material then passes through a guide 86 in the installation head 38 (see FIG. 2). Externally toothed feed rolls 88 and 90 engage the thread on the outside of the straightened rod material 32. The wheels 88 and 90 (FIG. 2) are driven to feed the rod material around an arcuate bend in the installation head 38. This results in the straightened rod material moving from the rod feeding and straightening assembly 34 along a generally horizontal and slightly upwardly skewed path to the installation head 38.

Installation Head

When rod material 32 is fed through the installation head 38, it moves around the bend in the installation head and is fed straight upwardly into the hole 48 in the mine roof 16. Movement of the rod material around the bend in the installation head 38 is guided by rollers 94. After the rod material has moved around the bend, rollers 96 cooperate to restraighten the rod material so that it is directed straight upwardly along a path which is coincident with the central axis of the mine roof hole 48.

Figure 4:
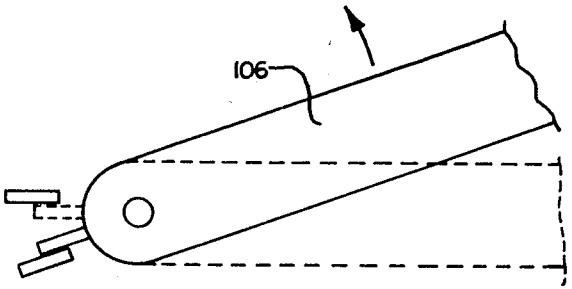
FIG. 4 is a schematic illustration depicting the manner in which an outer end portion of a boom is pivoted relative to the vehicle shown in FIG. 1 to position a rod installation head adjacent to an opening in the roof of a mine.

The boom 40 is adjustable vertically and sidewardly to enable the installation head 38 to be positioned with its outlet in alignment with the central axis of the mine roof hole 48 without moving the vehicle 12. Thus, a hydraulic piston and cylinder type motor 100 (see FIGS. 1 and 2) can be extended to raise the installation head 38 or retracted to lower the installation head. A second piston and cylinder type motor 104 (FIG. 1) is operable to pivot an outer section 106 of the boom in the manner illustrated schematically in FIG. 4. Thus, the boom 40 can be raised and lowered and pivoted so that the installation head 38 can be positioned in alignment with a hole formed in the mine roof 16 by the drilling assembly 20.

Before rod material 32 is fed from the installation head 38 into the hole 48 in the mine roof, a short length of rod material projects upwardly from the installation head 38. The fastener collar 44 (FIG. 5) is telescoped over the end of the rod material with a hole through the collar in axial alignment with the outlet from the installation head 38. At this time, the diameter of the hole through the collar 44 is greater than the maximum outside diameter of the rod material 32. The mine roof support plate 46 is placed over the end of the rod material with a hole in the central portion of the mine roof support plate aligned with the hole in the collar 44 and the outlet from the installation head 38. An anchor assembly is then connected with the upper end of the rod material at a location above the mine roof support plate 46.

The installation head 38 is then moved upwardly against the mine roof with the outlet from the installation head in axial alignment with the hole 48 in the mine roof. A pair of hydraulic motors 112 are then extended to move a pressure applicator member 114 (FIG. 5) upwardly against the mine roof support plate 46 to press the support plate 46 against the roof 16 of the mine. The feed rolls 88 and 90 (FIG. 2) in the installation head 38 and the feed and straightener rolls 70–78 in the apparatus 34 are then driven to feed rod material 32 upwardly through the hole in the collar 44 and the hole in the mine roof support plate 46 into the hole 48 in the mine roof 16. When the measuring apparatus associated with the rod feeder and straightener assembly 34 indicates that a desired length of rod has been fed into the hole 48, operation of the feed rollers is stopped.

Once the desired amount of rod material has been fed into the hole 48 of the mine roof, the anchor at the leading end of the rod material 32 is set in the hole to hold the rod material against axially downward movement. Thus, a mechanical anchor may be connected with the leading end of the rod material 32 before it is fed into the hole 48. The mechanical anchor is set by engaging the rod material 32 with a gripper assembly 120 (FIG. 5) and pulling downwardly on the rod material 32. The downward force on the rod material 32 pulls a wedge member in the mechanical anchor assembly axially downwardly to force a pair of shells having teeth in their outer side surfaces into firm abutting engagement with the inner side surface of the hole 48.

In order to firmly set the mechanical anchor and prevent subsequent loosening, a relatively large downward force is applied on the rod material 32 by the gripper 120. Once the anchor assemby has been set, the downward force applied to the rod material 32 by the gripper 120 is reduced. However, a substantial axial force is still maintained on the rod material 32 so that it is under tension. At this time, the mine roof plate 114 is being firmly pressed upwardly against the roof 16 of the mine by the presser member 114.

While the rod material 32 in the mine roof hole 48 is under the reduced but substantial tension force applied by the gripper 120 and the mine roof support plate 46 is being pressed upwardly with a relatively large force by the presser member 114, a swaging head 124 (FIG. 5) is raised to press the collar 44 upwardly against the mine roof support plate 46. The head 124 is then thrust over the collar to swage the collar radially inwardly into tight abutting engagement with the thread convolution on the outside of the rod material 32. This results in the collar 44 firmly gripping the external thread convolution on the rod material to hold the mine roof support plate 46 in place.

After the collar 44 has been securely connected to the rod material 32, the pressure applicator member 114 is retracted and the rod material is cut immediately beneath the collar 44 by a pair of cutters 128 and 130. Since the collar 44 was swaged in place while a substantial tension force was applied to the rod member 32 by the gripper 120, the collar 44 is pulled upwardly against the mine roof support plate 46 by the cut rod material 32. This enables the collar 44 to firmly press the mine roof support plate against the roof of the mine with a predetermined force.

The manner in which the collar 44 is swaged in place on the rod material 32 while the gripper 120 applies a tension force to the rod material is generally similar to the manner in which collars are swaged onto bolts with commercially available equipment sold by Huck Manufacturing Company, 8001 Imperial Drive, Waco, Tx. 76710 for the C50L Fastening System. Of course, other types of known fasteners could be used if desired. For example, wedge members having internal thread convolutions which grip the external thread convoluton on the rod material 32 could be held in place by tapered surfaces of a collar.

Although the foregoing explanation is related to the use of a mechanical type anchor, it is contemplated that a resin/grout type anchor or a combination resin and mechanical anchor could be used if desired. When this is done, the same procedure as previously described in connection with a mechanical anchor would be followed. However, the step of initially applying a relatively large axial force to the rod material 32 with the gripper 120 to set the anchor assembly would be omitted with the resin/grout anchor since this step would not be necessary. However, the gripper 120 would be used to apply an axial force to the rod 32 so that it is tensioned before the collar 44 is swaged in place. This results in a strong tension force being present in the rod material 32 in the hole 48 to clamp the mine roof support plate 46 firmly against the roof of the mine.

Figure 6:
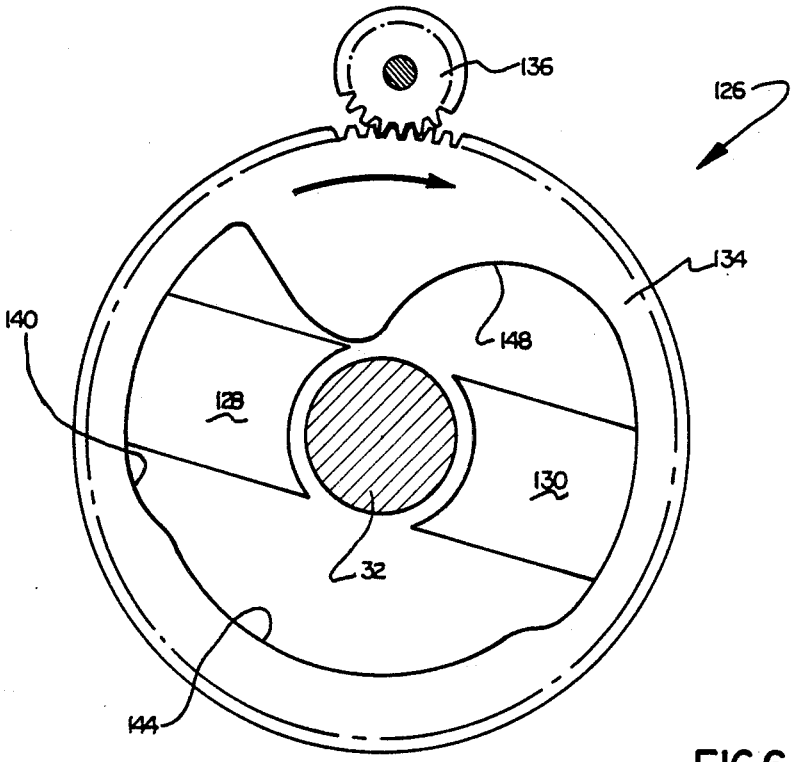
FIG. 6. is a fragmentary schematic illustration of an apparatus for cutting a piece of rod material to separate it from the coil of rod material.

The cutter 126 (FIG. 6) includes an anvil or support member 128 and a cutter member 130. When the rod material 32 is to be cut, a cam member 134 is rotated in a clockwise direction, as viewed in FIG. 6, by a drive gear 136. Initial rotation of the cam member 144 causes a cam surface 140 to move the anvil member 128 into engagement with the rod material 32. Continued rotation of the cam member 134 causes a cam surface 148 to move the cutter member 130 inwardly to shear off the rod material. If desired, other known types of rod cutters could be utilized. Of course other types of cutters could be used if desired.

SUMMARY

In view of the foregoing description, it is apparent that the present invention provides a new and improved method and apparatus 10 for quickly installing mine roof supports. The apparatus 10 includes a vehicle 12 which carries a coil 28 of rod material. After a hole 48 has been drilled in the roof 16 of the mine, preferably by a drill 20 mounted on the vehicle, rod material 32 is fed from the coil and straightened. The straightened rod material 32 is inserted into the hole 48 in the mine roof and anchored in place. A fastener 44 is connected with the length of rod material in the hole to press a support plate 46 upwardly against the roof of the mine. The rod material 32 is cut to separate the length of rod material in the hole from the coil of material.

When a mechanical anchor is used with the rod material 32, the rod material is pulled downwardly with a relatively large force by a gripper 120 to firmly set the mechanical anchor in the hole 48. This relatively large downward force is then reduced and, while the reduced force is maintained on the rod material 32, the fastener 44 is secured against the mine roof support plate 46 to hold it in position. The downward force on the rod material is then released so that the rod material pulls the fastener 44 firmly upwardly against the mine roof support plate 46. When a resin or grout type anchor is used, only the reduced or anchoring force is applied against the rod material.

Having described one specific preferred embodiment of the invention, the following is claimed:

1. A method of installing mine roof support plates at a plurality of locations in a mine, said method comprising the steps of drilling a first hole in a mine roof at a first location in the mine, moving a coil of rod material to the first location in the mine, feeding rod material from the coil of rod material while the coil is at the first location in the mine, straightening the rod material fed from the coil, connecting a first expandable anchor assembly to an end of the rod material, inserting the first anchor assembly into the first hole, said step of inserting the first anchor assembly into the first hole including feeding rod material upwardly through a first fastener and a first mine roof support plate into the first hole, setting the first anchor assembly in the mine roof by pulling downwardly on the rod material with a first force to expand the first anchor assembly after having inserted the first anchor assembly into the first hole, thereafter, pulling downwardly on the rod material with a second force which is less than the first force, pressing the first mine roof support plate against the mine roof at the first location, connecting the first fastener with the rod material while pressing the first mine roof support plate against the mine roof and while pulling downwardly on the rod material with the second force to enable to fastener to cooperate with the rod material to press the first mine roof support plate against the roof of the mine at the first location with a force having a magnitude which is a function of the magnitude of the second force, thereafter, cutting the rod material to separate the coil of rod material from the rod material in the first hole, drilling a second hole in the roof of the mine at a second location in the mine, moving the coil of rod material from the first location to the second location in the mine, connecting a second expandable anchor assembly to an end of the rod material formed as a result of having performed said step of cutting the rod material, inserting the second anchor assembly into the second hole, said step of inserting the second anchor assembly into the second hole including feeding rod material upwardly through a second fastener and a second mine roof support plate into the second hole, setting the second anchor assembly in the mine roof by pulling downwardly on the rod material with a force of a magnitude which is substantially the same as the magnitude of the first force to expand the second anchor assembly after having inserted the second anchor assembly into the second hole, thereafter, pulling downwardly on the rod material with a force which is of substantially the same magnitude as the second force, pressing the second mine roof support plate against the mine roof at the second location, connecting the second fastener with the rod material while pressing the second mine roof support plate against the mine roof and while pulling downwardly on the rod material with a force of a magnitude which is substantially the same as the magnitude of the second force to enable the second fastener to cooperate with the rod material to hold the second mine roof support plate against the roof of the mine at the second location with a force which is a function of the magnitude of the second force, and, thereafter, cutting the rod material to separate the coil of rod material from the rod material in the second hole.

2. A method as set forth in claim 1 wherein the rod material has an external thread convolution, said step of feeding rod material through a first fastener includes feeding rod material through an opening which is at least partially defined by an internal side wall of the first fastener, said step of connecting the first fastener with the rod material includes the step of gripping the external thread convolution with the internal side wall of the first fastener, said step of feeding rod material through a second fastener includes feeding rod material through an opening which is at least partially defined by an internal side wall of the second fastener, said step of connecting the second fastener with the rod material includes the step of gripping the external thread convolution with the internal side wall of the second fastener.

3. A method as set forth in claim 2 wherein said steps of gripping the external thread convolution with the first and second fasteners include swaging the first and second fasteners to decrease the size of the openings through the first and second fasteners.

4. A method of installing mine roof supports, said method comprising the steps of providing a coil of rod material having an external thread, transporting the coil of rod material into a mine, thereafter performing the following steps in the mine, removing rod material from the coil, connecting an internally threaded anchor assembly to an end of the rod material by engaging an internal thread in the anchor assembly with the external thread on the rod material, thereafter, inserting the anchor assembly into a hole in the roof of the mine, said step of inserting the anchor assembly into the hole in the roof of the mine including feeding rod material from the coil upwardly through a fastener and a mine roof support plate into the hole in the roof of the mine, thereafter, pulling downwardly on the rod material with a first force to set the anchor assembly in the hole in the roof of the mine, thereafter, pulling downwardly on the rod material with a second force which is less than the first force, connecting the fastener with the rod material by engaging the external thread on the rod material with the fastener, said step of connecting the fastener with the rod material being performed while performing said step of pulling downwardly on the rod material with a second force, thereafter, cutting the rod material to separate the coil of rod material from the rod material in the hole in the roof of the mine, and pressing the mine roof support plate against the roof of the mine with a force which is transmitted between the anchor assembly and mine roof support plate by the fastener and the rod material cut from the coil, said step of pressing the mine roof support plate the roof of the mine including pressing the mine roof support plate against the roof of the mine with a force which is a function of the second force.

5. A method as set forth in claim 4 wherein said step of feeding rod material through a fastener includes feeding rod material through a circular opening in a fastener, said step of connecting the fastener with the rod material including deforming the fastener to decrease the size of the opening and to press the material of the fastener against the external thread.

6. An apparatus for use in installing mine roof support plates at a plurality of locations in a mine, said apparatus comprising a vehicle which is movable along the floor of the mine to each of the locations where a mine roof support plate is to be installed, drill means for forming holes in the roof of the mine, first boom means having an inner end portion connected with said vehicle and an outer end portion connected with said drill means, first motor means for moving said first boom means relative to said vehicle to position said drill means to form a hole in the roof of the mine, coil support means connected with said vehicle for supporting a coil of rod material for rotation about a central axis of the coil, first feeder means connected with said vehicle for feeding rod material from the coil while the coil is supported by said coil support means, straightener means connected with said vehicle for straightening rod material fed from the coil by said first feeder means, second boom means having an inner end portion connected with said vehicle and an outer end portion, second feeder means connected with said outer end portion of said second boom means for feeding straightened rod material around a bend and for feeding rod material straight upwardly from the bend into a hole in the roof of the mine, second motor means for moving said second boom means relative to said vehicle to position said second feeder means to feed rod material into a hole in the roof of the mine, presser means connected with said outer end portion of said second boom means for pressing a mine roof support plate against the roof of the mine, means connected with said outer end portion of said second boom means for connecting a fastener with the rod material at a location adjacent to the mine roof support plate while the mine roof support plate is being pressed upwardly by said presser means, and cutter means connected with said outer end portion of said second boom means for cutting the rod material to separate the rod material in a hole in the roof of the mine from the coil.

7. An apparatus as set forth in claim 6 further including gripper means connected with said outer end portion of said second boom means for gripping a piece of rod material adjacent to the mine roof support plate and pulling downwardly on the rod material disposed in a hole in the roof of the mine, said means for connecting a fastener with the rod material being operable to connect the fastener with the rod material while the rod material is being pulled downwardly by said gripper means.

* * * * *